US011591834B2

(12) United States Patent
Guelck

(10) Patent No.: US 11,591,834 B2
(45) Date of Patent: Feb. 28, 2023

(54) SASH LOCK CAPABLE OF BI-DIRECTIONAL ENGAGEMENT

(71) Applicant: PLY GEM INDUSTRIES, INC., Cary, NC (US)

(72) Inventor: Volker Guelck, Calgary (CA)

(73) Assignee: Ply Gem Industries, Inc., Cary, NC (US)

( * ) Notice: Subject to any disclaimer, the term of this patent is extended or adjusted under 35 U.S.C. 154(b) by 492 days.

(21) Appl. No.: 16/451,464

(22) Filed: Jun. 25, 2019

(65) Prior Publication Data

US 2020/0408012 A1 Dec. 31, 2020

(51) Int. Cl.

| | |
|---|---|
| ***E05C 3/04*** | (2006.01) |
| ***E05C 7/00*** | (2006.01) |
| ***E05B 65/08*** | (2006.01) |

(52) U.S. Cl.

CPC ..... *E05C 3/046* (2013.01); *E05B 65/0841* (2013.01); *E05C 7/00* (2013.01); *E05C 2007/007* (2013.01); *E05Y 2900/148* (2013.01)

(58) Field of Classification Search

CPC ..... E05C 3/046; E05C 7/00; E05C 2007/007; E05C 3/041; E05C 3/04; E05C 3/045; E05C 7/02; E05B 65/0841; E05B 2065/0805; E05B 2001/0076; E05Y 2900/148; Y10S 292/20; Y10S 292/47; Y10S 292/30

See application file for complete search history.

(56) References Cited

U.S. PATENT DOCUMENTS

| | | | | | |
|---|---|---|---|---|---|
| 1,149,090 | A * | 8/1915 | Schmidt | E05B 83/10 | 292/202 |
| 1,743,434 | A * | 1/1930 | Cramer | E05C 3/043 | 292/228 |
| 1,878,544 | A * | 9/1932 | Schmidt | E05C 3/043 | 292/213 |
| 2,018,098 | A * | 10/1935 | Sullivan | E05C 3/042 | 292/202 |
| 2,041,625 | A * | 5/1936 | Schmidt | E05B 15/0205 | 292/346 |
| 2,634,146 | A * | 4/1953 | Johnson | E05C 3/042 | 292/240 |
| 4,418,951 | A * | 12/1983 | Schultz | E05C 3/041 | 292/202 |
| 5,688,003 | A * | 11/1997 | Beale | E05C 3/10 | 292/202 |
| 7,000,957 | B2 * | 2/2006 | Lawrence | E05C 3/046 | 292/DIG. 7 |

(Continued)

*Primary Examiner* — Kristina R Fulton
*Assistant Examiner* — Steven A Tullia
(74) *Attorney, Agent, or Firm* — Lathrop GPM LLP

(57) ABSTRACT

A sash lock for a sash window assembly is disclosed. The sash window assembly includes an upper sash window and a lower sash window. Each of the sash windows is mounted within opposed guide rails on a master frame. At least one of the sash windows is slidable within the frame relative to the other sash window. The sash lock comprises either a keeper, with a keeper opening, for mounting on a rail of one of the sash windows or a recess in the lower rail of the upper sash. The sash lock disclosed herein includes a housing having a hole, an actuator arm, and a cam having a cam element for receipt into the keeper opening or the recess. The locking assembly also includes a shaft extending through the housing hole and operably coupling the actuator arm to the cam.

14 Claims, 6 Drawing Sheets

(56) References Cited

U.S. PATENT DOCUMENTS

| | | | | |
|---|---|---|---|---|
| 7,665,775 | B1 * | 2/2010 | Miller | E05B 65/0841 292/DIG. 20 |
| 9,341,006 | B1 * | 5/2016 | Lawrence | E05B 65/0841 |
| 2004/0026932 | A1 * | 2/2004 | Coleman | E05C 3/046 292/241 |
| 2009/0014905 | A1 * | 1/2009 | Liang | B29C 48/0022 264/176.1 |
| 2009/0189398 | A1 * | 7/2009 | Lawrence | E05C 3/046 292/241 |
| 2010/0132263 | A1 * | 6/2010 | Flory | E05D 15/22 49/394 |
| 2014/0035298 | A1 * | 2/2014 | Glickman | E05C 3/046 292/241 |
| 2017/0152688 | A1 * | 6/2017 | Liang | E05C 1/06 |

* cited by examiner

SASH LOCK CAPABLE OF BI-DIRECTIONAL ENGAGEMENT

TECHNICAL FIELD

This disclosure is directed to a sash lock for locking the upper and lower sashes of a window against relative movement by rotating a locking cam via an actuator arm either clockwise or counter-clockwise into a retaining feature.

BACKGROUND

Sash locks for double hung window assemblies are commonly known in the art. A double hung window assembly generally has an upper sash window and a lower sash window within a master frame. Typical sash locks draw opposed frame members of the sash windows together and lock the sashes preventing them from sliding within the master frame.

This invention relates to a sash lock, particularly to a sash lock having a means to rotate a locking cam to within a recess in the lower rail of the upper sash or into an opening of a keeper mounted to the upper surface of the lower rail of the upper sash.

SUMMARY

The sash window assembly disclosed herein includes an upper sash window and a lower sash window. Each of the sash windows are mounted within opposed guide rails on a master frame wherein at least one of the sash windows is slidable within the frame relative to the other sash window. The operation of the sash lock requires either a keeper for mounting on a base rail of one of the sash windows or into a recess in the lower rail of the upper sash for engagement with the cam of the sash lock. The keeper includes a keeper surface. The sash lock also includes a locking assembly for mounting on an adjacent top rail of the other of the sash windows.

The sash lock disclosed herein includes a housing having an aperture, an actuator arm having a shaft disposed along a rotational axis and within the aperture of the housing, and a cam having a cam surface for receipt into the opening of the keeper or into a recess in the rail of a sash.

An object of the disclosed sash lock is to provide a sash lock which may positively lock the cam in position and may not easily be opened from outside.

Another object of the disclosed sash lock is to provide a sash lock which may easily be locked or unlocked from inside.

Another object of the disclosed sash lock is the ability to ensure locking engagement with either clockwise or counter-clockwise rotation of the actuator arm that rotates the cam into locking position.

Another object of the disclosed sash lock is the ready ability of the user to discern when the upper and lower sashes are unlocked.

Still another object of the disclosed sash lock is to provide a sash lock which is simple, compact and strong with an external appearance that is appealing with easy operation.

The contents of this summary section are provided only as a simplified introduction to the disclosure, and are not intended to be used to limit the scope of the appended claims.

Various objects, features, aspects and advantages of the disclosed subject matter will become more apparent from the following detailed description of preferred embodiments, along with the accompanying drawings in which like numerals represent like components. The contents of this summary section are provided only as a simplified introduction to the disclosure, and are not intended to be used to limit the scope of the appended claims.

DETAILED DESCRIPTION

The following description is of various exemplary embodiments only, and is not intended to limit the scope, applicability or configuration of the present disclosure in any way. Rather, the following description is intended to provide a convenient illustration for implementing various embodiments including the best mode. As will become apparent, various changes may be made in the function and arrangement of the elements described in these embodiments without departing from the scope of the appended claims.

Figure 1:
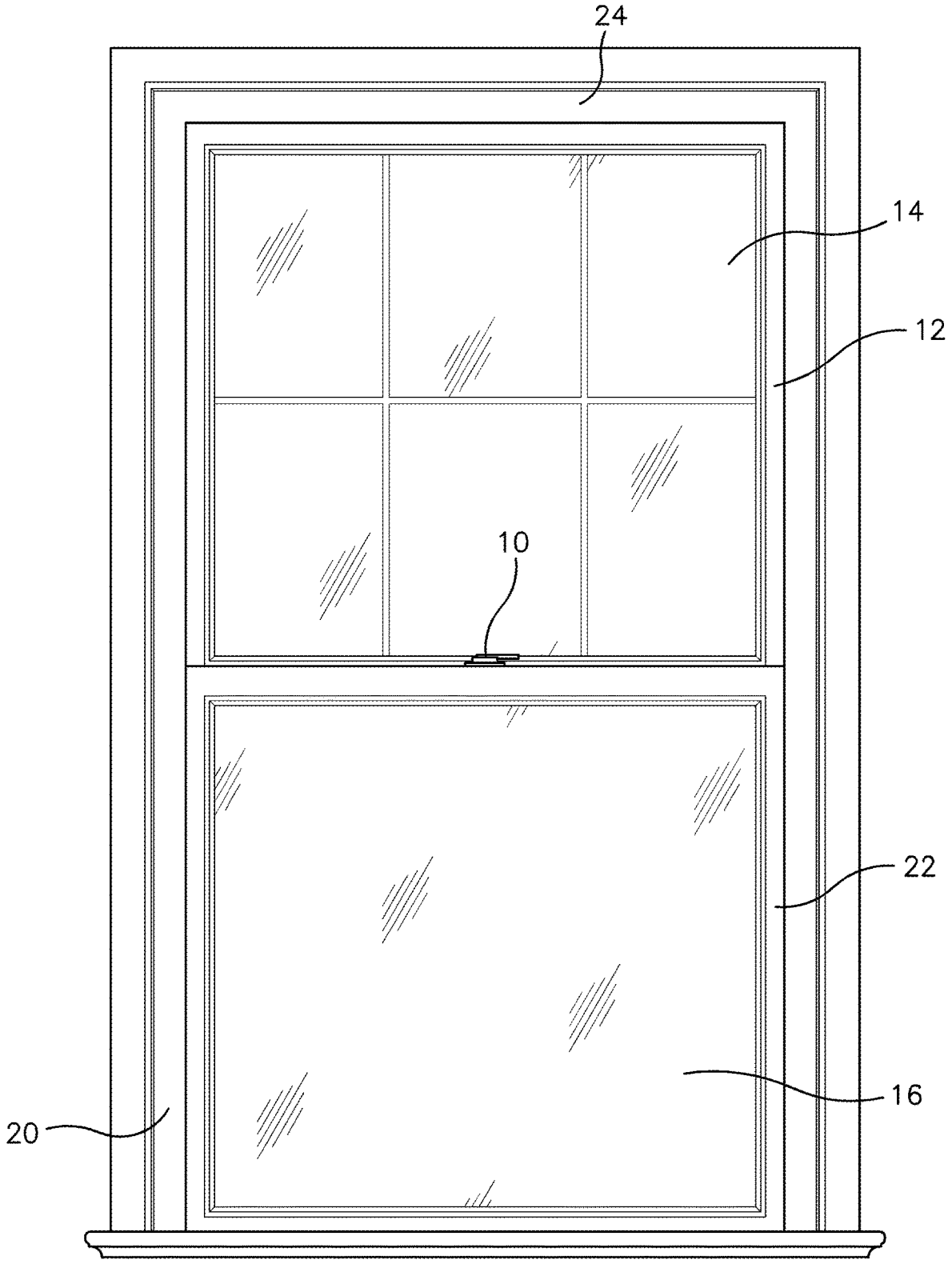
FIG. 1 illustrates a perspective view of a window master frame.

As seen in FIG. 1, disclosed herein is a sash lock 10 for use in a sash lock window assembly 12. The sash window assembly 12 includes an upper sash window 14 and a lower sash window 16. Each of the sash windows are mounted within opposed guide rails 20, 22 on a master frame 24, wherein at least one of the sash windows is slidable within the frame 24 relative to the other sash window.

Figure 2:
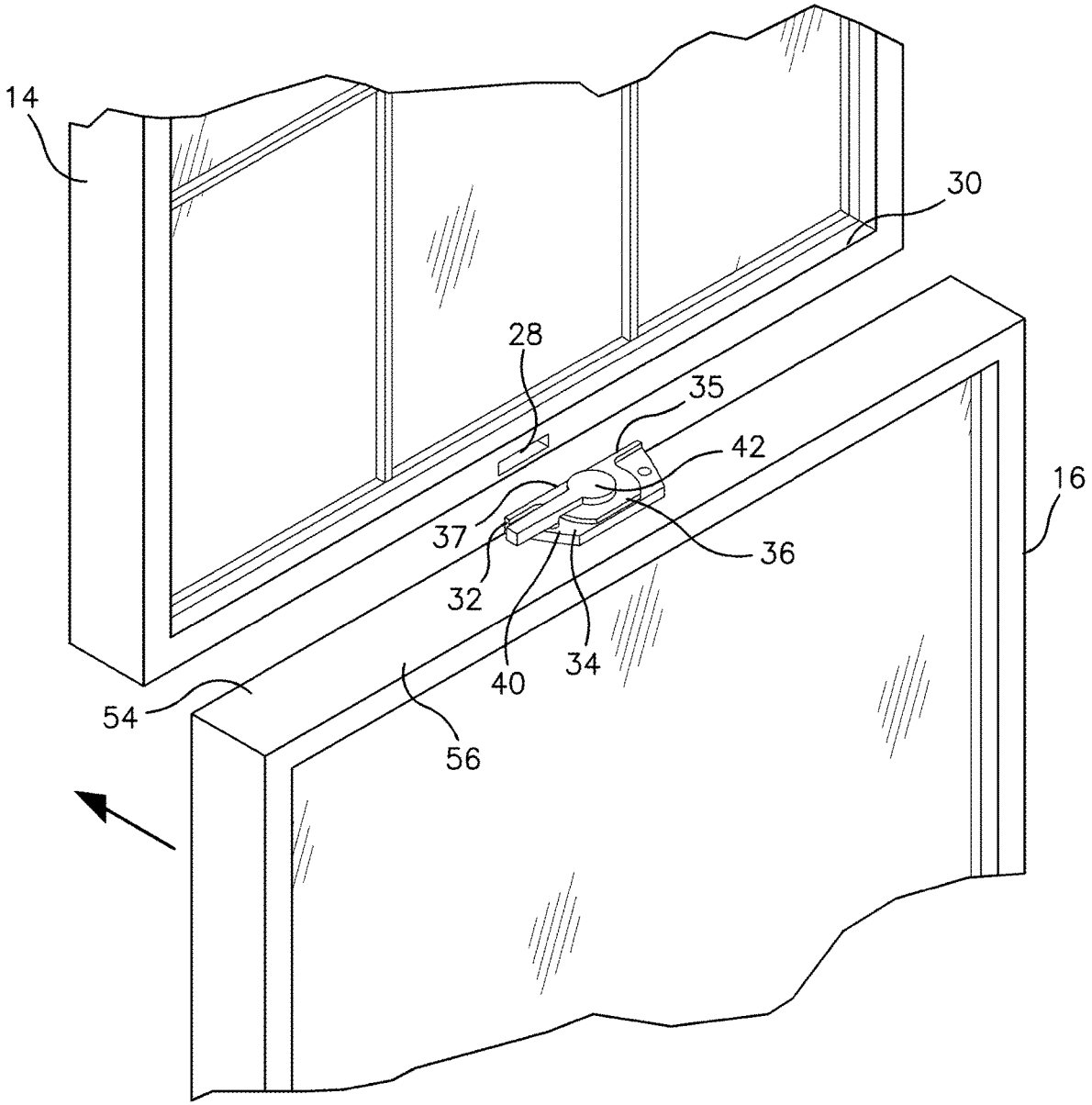
FIG. 2 illustrates a perspective view of upper and lower sash rails in proximity to one another with an embodiment of the sash lock in position.
Figure 3:
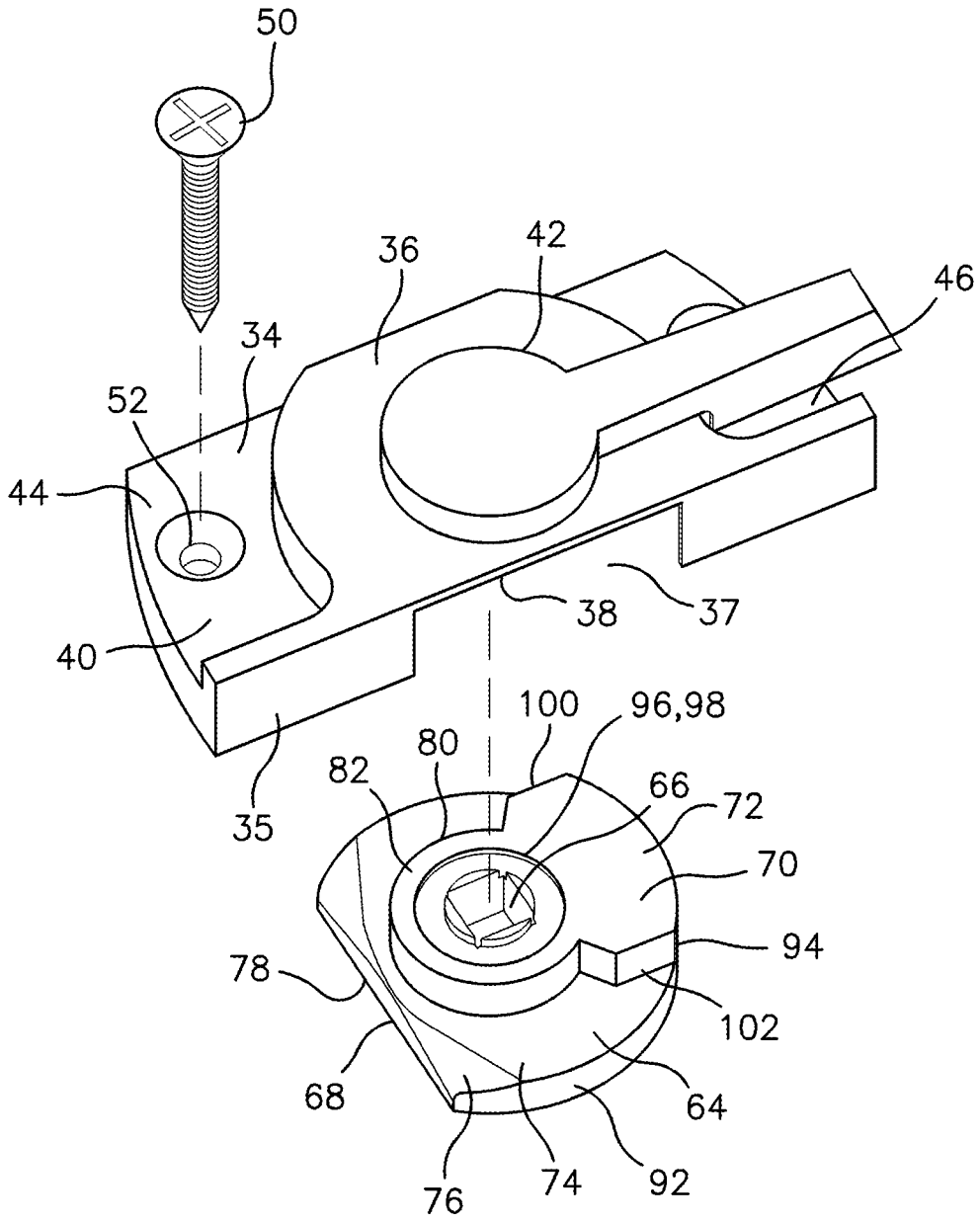
FIG. 3 illustrates a partially exploded view of an embodiment of the sash lock.

As seen in FIGS. 2 and 3, the sash lock 10 operates in a first configuration by engaging within a slot 28 disposed within a lower rail 30 of the upper sash 14 and preventing movement of the upper sash 14 relative to the lower sash 16. The sash lock 10 includes a housing 34 with a raised section 36, downwardly extending flanges 35 and a building exterior-facing cam opening 37. The housing 34 includes an interior surface 38 and an exterior surface 40 as well as a hole 42 through the raised section 36. The housing 34 further includes two lower sections 44, 46 oppositely disposed from one another across the raised section 36 and threaded fasteners 50 passing through openings 52 in the two lower sections 44, 46 securing the housing 34 to the top surface 54 of the upper rail 56 of the lower sash 16.

As seen in FIG. 3, the sash lock 10 further utilizes a cam 64 with a through hole 66 therein. The cam 64 is positioned beneath the housing 34 and is shaped as a truncated circle with a linear edge segment 68 and an elevated portion 70 disposed opposite the linear edge segment 68. The cam 64 also includes a top surface 72 of the elevated portion 70. When in an operational position atop the upper rail 56 of the lower sash 16, the cam 64 is closely spaced to the interior surface 38 of the housing 34 such that a gap of no greater than 0.10 inches and preferably no greater than 0.05 inches exists between the top surface 72 of the elevated portion 70 and the interior surface 38 of the housing 34.

The cam 64 includes a base 74 with a top surface 76 and a bottom surface 78. Extending upwardly from the top surface 76 of the base 74 is a circular shaped boss 80. The boss 80 extends upwardly to the boss upper surface 82. The upper surface 72 of the elevated portion 70 of the cam 64 also achieves a height roughly equivalent to the height of the upper surface 82 of the boss 80. As previously discussed, the gap separating the boss upper surface 82, the elevated portion upper surface 84 and the interior surface 38 of the housing 34 is no greater than 0.10 inch and preferably no greater than 0.05 inches. At the center 86 of the boss 80 is the through hole 66, preferably with a non-circular cross-section, the rationale for such preferred non-circular cross-section is discussed below. Disposed directly and symmetrically opposite the linear edge segment 68 from the through hole 66, the elevated portion 70 of the cam 64 spans in the range of about 45 to 90 degrees of the total circumference.

As seen in FIG. 3, the elevated portion 70 of the cam 64 includes an outer edge 94 that is co-extensive with an outer edge 92 of the base 74. The elevated portion 70 of the cam 64 also includes an inner edge 96 that is co-extensive with an outer edge 98 of the circular boss 80. The elevated portion 70 also has first and second laterally opposed vertical surfaces 100, 102 substantially perpendicular to the base 74. As discussed above, the linear edge segment 68 is a chord C, the length of which is inter-dependent upon the central angle θ and the radius R of the cam 64.

Figure 4:
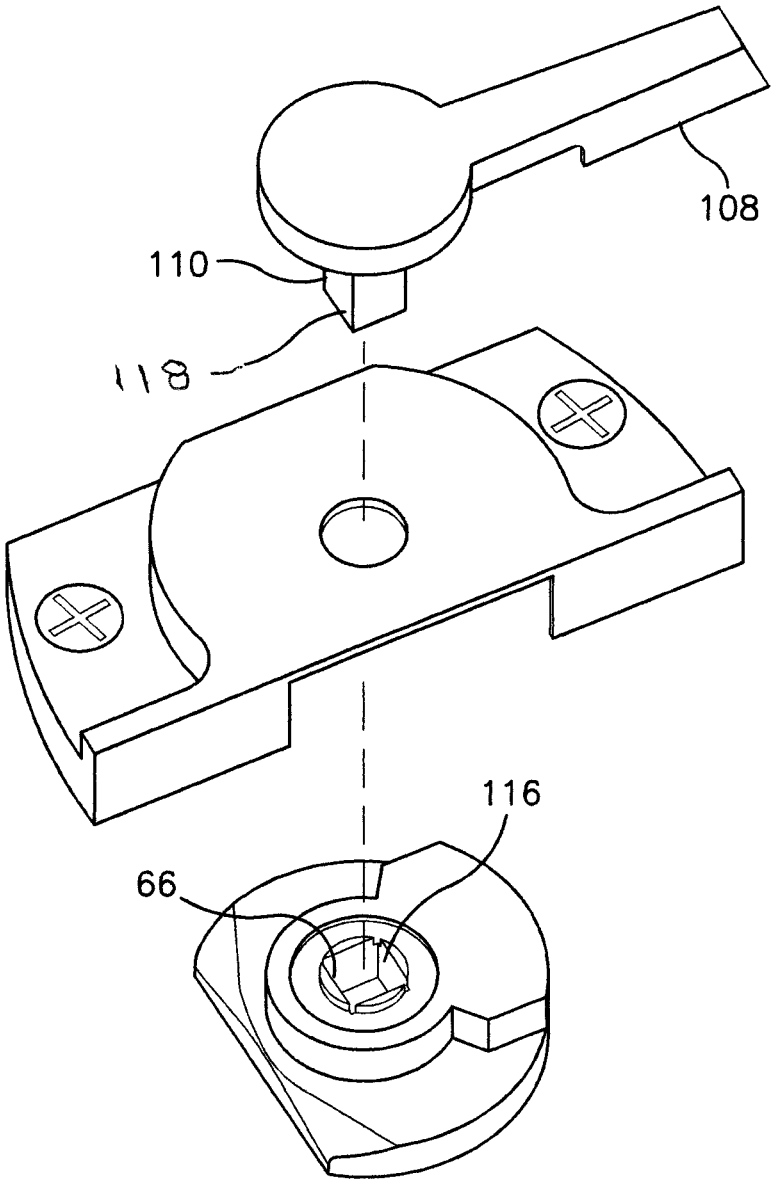
FIG. 4 illustrates an exploded view of an embodiment of the sash lock.

As seen in FIG. 4, the sash lock 10 utilizes an actuator arm 108 with a shaft 110 extending outwardly from the actuator arm 108. The actuator arm shaft 110 extends through the housing hole 112 as well as the cam through hole 66 operably coupling the actuator arm 108 to the cam 64 because the actuator arm shaft 110 and the cam through hole 66 have corresponding circumferential surfaces, 116, 118 that are preferably non-circular. The actuator arm shaft 110 preferably engages with the cam 64 with a non-circular configuration to eliminate slippage between the actuator arm shaft 110 and the through hole 66. Once the actuator arm shaft 110 is pressed into the cam through hole it is retained in that position and not readily removed during operation.

Figure 5:
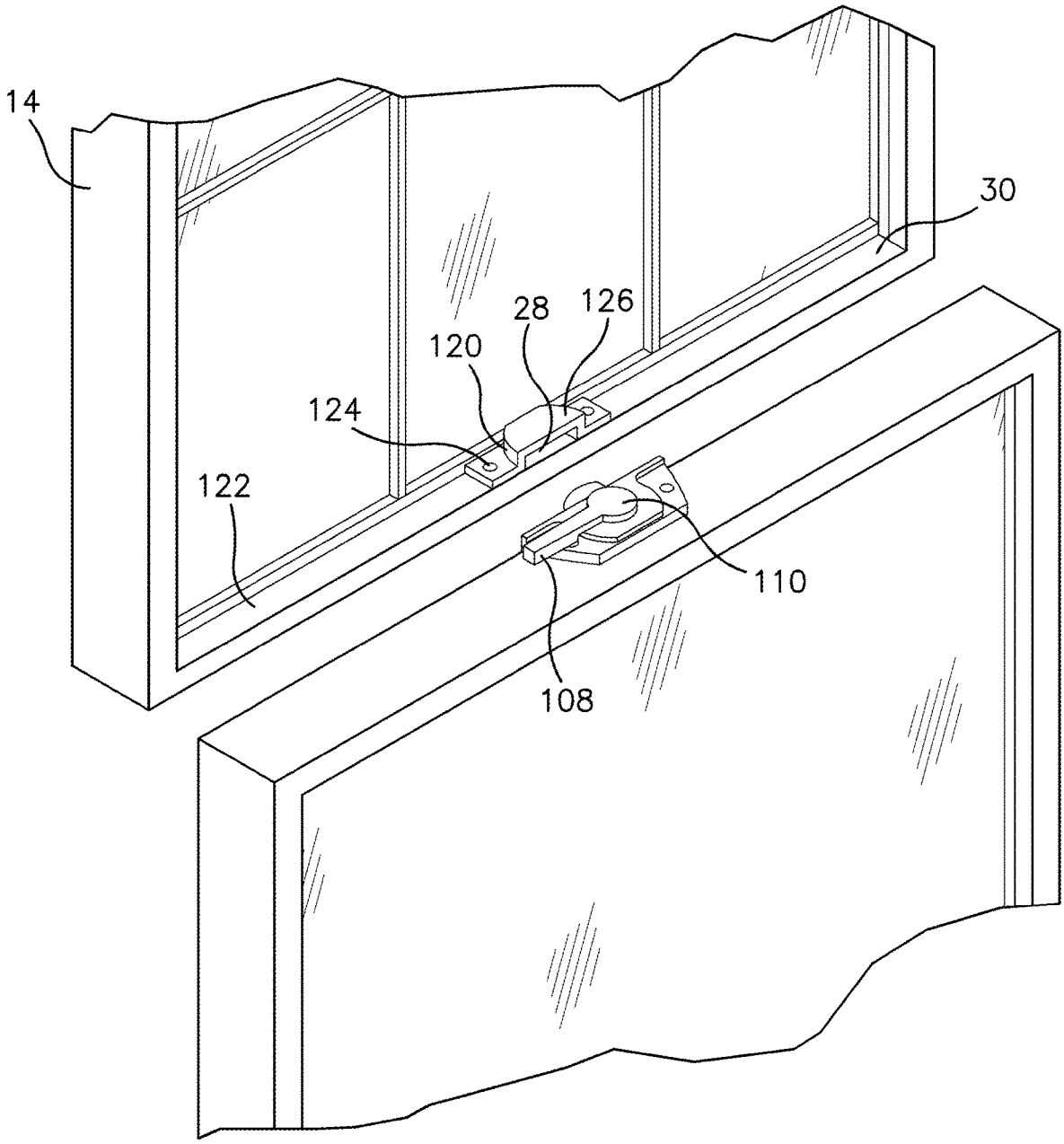
FIG. 5 illustrates a perspective view of a window master frame and embodiment of the sash lock in position on the rail of the lower sash.

As seen in FIG. 5, an alternative utilization of the sash lock 10 is for receipt not into a slot 28 in the lower rail 30 of the upper sash 14 but into a keeper 120 that is fastened to an upper surface 122 of the lower rail 30 of the upper sash 14. The keeper 120 is generally a bracket feature that is mounted by standard fasteners 124 to the upper surface 122 and includes a keeper opening 126. The keeper opening 126 is an opening configured to receive the rotatable cam 64 and prevent motion of the upper and lower sash 14, 16 relative to one another.

In operation, the sash lock 10 is in an unlocked position when the actuator arm 108 extends perpendicular to the rails 30, 34. To engage the sash lock 10 so that it restricts movement of the upper and lower sashes 14, 16 relative to one another the actuator arm 108 is rotated, typically by hand, roughly a quarter turn either in a clockwise or counterclockwise direction. Rotation of the actuator arm 108 causes the actuator arm shaft 110 to similarly rotate due to the corresponding circumferential surfaces. As previously noted, a non-circular cross-sectional shaft is preferred so that slippage between the shaft 110 and the through hole 66 of the cam 64 does not result upon rotation of the shaft 110.

Figure 6A:
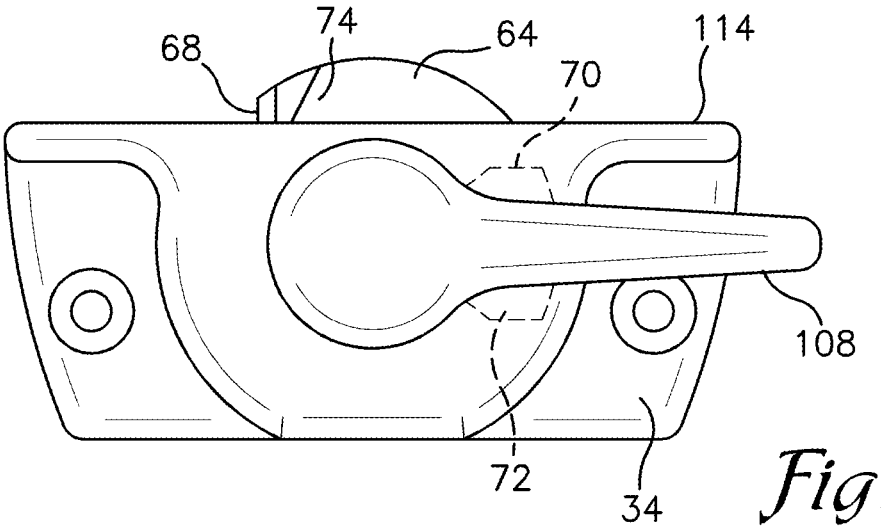
FIG. 6A illustrates a plan view of an embodiment of the sash lock with the actuator arm to the right in a locked position.

As seen in FIG. 6A when the actuator arm 108 rotates the cam 64 counter-clockwise (from the orientation seen in FIG. 6C) the linear edge segment 68 transitions from being aligned with the exterior facing edge 114 of the housing 34 to an orientation where only a portion of the base 74 extends outwardly from the exterior facing edge 114 of the housing 34 into the slot 28 (not shown) or alternatively the keeper opening 126 (not shown). As the actuator arm 108 rotates the cam 64 rotates counter-clockwise the elevated portion 70 (shown in phantom lines) remains beneath the housing 34 and because of the close-proximity of the top surface 72 of the elevated portion 70 to the interior surface 38 of the housing 34 the entire cam 64 is restrained against upward movement. As an upward force is applied to the lower sash 16 or a downward force is applied to the upper sash 14 the cam 64 orientation remains essentially horizontal due to the restraint provided by the housing 34.

Figure 6B:
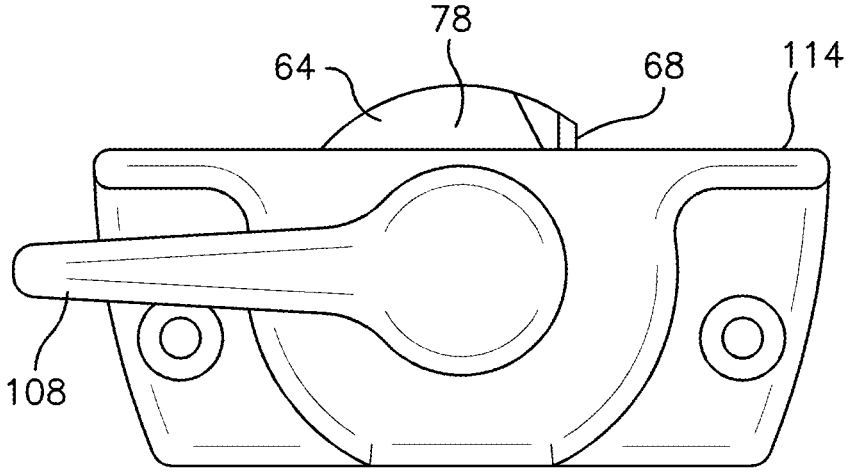
FIG. 6B illustrates a plan view of an embodiment of the sash lock with the actuator arm to the left in a locked position.

As seen in FIG. 6B, as the actuator arm 108 rotates the cam 64 clockwise (from the orientation seen in FIG. 6C), the linear edge segment 68 transitions from being aligned with the exterior facing edge 114 of the housing 34 to an orientation where only a portion of the base 74 extends outwardly from the exterior facing edge 114 of the housing 34 into the slot 28 (not shown) or alternatively the keeper opening 126 (not shown). As the cam 64 rotates horizontally counter-clockwise the elevated portion 70 remains beneath the housing 34 and because of the close-proximity of the top surface 72 of the elevated portion 70 to the interior surface 38 of the housing 34 the entire cam 64 is restrained against upward movement. As an upward force is applied to the lower sash 16, or a downward force is applied to the upper sash 14, the cam orientation remains essentially horizontal due to the restraint provided by the housing 34. The sash lock is equally effective at restricting movement of the upper and lower sashes relative to one another without limitation on whether the actuator arm 108 rotates clockwise or counterclockwise.

Figure 6C:
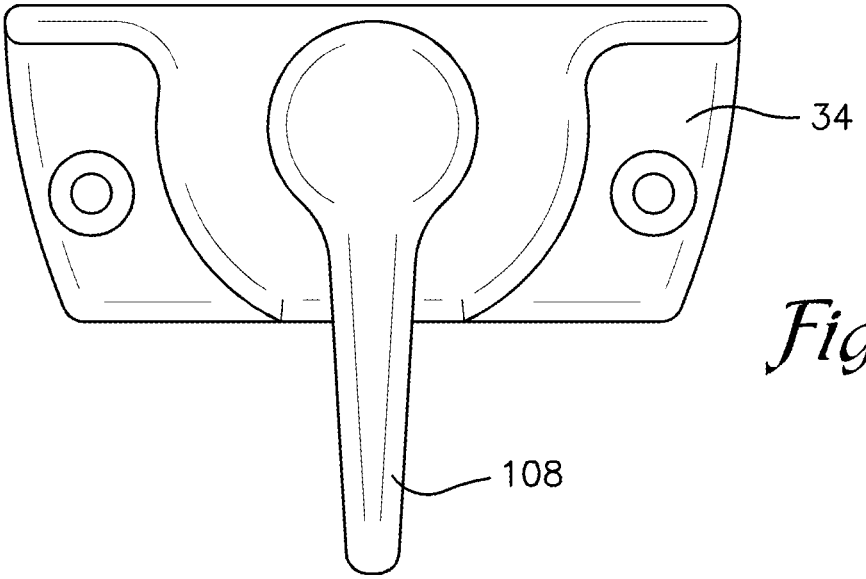
FIG. 6C illustrates a plan view of an embodiment of the sash lock with the actuator arm perpendicular to the orientations in FIGS. 6A and 6B and in an unlocked position.

FIG. 6C reveals the sash lock in a position with the cam 64 fully retracted beneath the housing 34. To achieve this orientation the actuator arm 108 is rotated perpendicular to the window rails 30, 34. With the cam 64 fully retracted, and therefore not inserted into a recess in a rail or into a keeper opening 126.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometries, materials, dimensions, ratios, steps, and the like discussed above are illustrative and are not required. Accordingly, the scope of the present invention should be considered in terms of the following claims and is understood not to be limited to the details of structure and operation shown and described in the specification and drawings. Moreover, the order of the components detailed in the system may be modified without limiting the scope of the disclosure.

I claim:

1. A sash lock for a sash window assembly, the sash window assembly including an upper sash window and a lower sash window, each of the sash windows mounted within opposed guide rails on a master frame, wherein at least one of the sash windows is slidable within the frame relative to the other sash window, the sash lock comprising:

a slot disposed within a lower rail of the upper sash; and a locking assembly for mounting on an upper rail of the lower sash, the locking assembly further comprising:

a housing comprising a raised section with an upper internal surface and an external surface, a hole through the raised section, and two lower sections oppositely disposed from one another across the raised section;

an actuator arm with a shaft extending outwardly therefrom;

a cam with a through hole therein, the cam disposed beneath the housing and shaped as a truncated circle with a linear edge segment, a base with an outer edge and an elevated portion with a uniform height disposed atop the base, an upper surface of the base symmetrically disposed on opposite sides of the elevated portion, the elevated portion further disposed opposite the linear edge segment and further comprising an outer edge coextensive with the outer edge of the base, a top surface of the elevated portion in direct contact with the upper internal surface of the housing; the actuator arm shaft extending through the housing hole as well as the cam through hole and operably coupling the actuator arm to the cam; and the actuator arm shaft and the cam through hole comprising corresponding circumferential surfaces; wherein the cam is operable for bi-directional rotational receipt into a cam opening within the housing.

2. The sash lock for a sash window assembly of claim 1, wherein a circular boss extends upwardly from the cam base and the boss surrounds the through hole.

3. The sash lock for a sash window assembly of claim 1, wherein the elevated portion spans in the range of about 45 to 90 degrees of the total circumference of the cam.

4. The sash lock for a sash window assembly of claim 1, wherein the elevated portion of the cam includes an outermost circumferential surface co-extensive with a portion of the outermost circumference of the base.

5. The sash lock for a sash window assembly of claim 2, wherein the elevated portion of the cam comprises a surface coextensive with the circular boss.

6. The sash lock for a sash window assembly of claim 1, wherein the elevated portion has first and second laterally opposed surfaces substantially perpendicular to the base.

7. The sash lock for a sash window assembly of claim 1, wherein the top surface of the elevated portion of the cam is spaced to no greater than 0.10 inch from the interior surface of the housing.

8. A sash lock for a sash window assembly, the sash window assembly including an upper sash window and a lower sash window, each of the sash windows mounted within opposed guide rails on a master frame, wherein at least one of the sash windows is slidable within the frame relative to the other sash window, the sash lock consisting of:

a keeper for mounting atop a lower rail of the upper sash, the keeper including a keeper opening; and a locking assembly for mounting atop an upper rail of the lower sash window, the locking assembly including:

a housing having a through hole;

an actuator arm;

a cam with a through hole and a base, the cam operable for bi-directional rotational receipt into the keeper opening, the cam shaped as a truncated circle with a linear edge segment and a single level elevated portion disposed atop the base and opposite the linear edge segment, wherein an upper surface of the base is symmetrically disposed on opposite sides of the elevated portion, the elevated portion further comprising an outer edge coextensive with the outer edge of the base, a top surface of the elevated portion in direct contact with an upper internal surface of the housing;

a shaft extending from the actuator arm, the shaft passing through the housing hole and the cam through hole, the shaft operably coupling the actuator arm to the cam, wherein the shaft and the hole are configured with corresponding circumferential surfaces.

9. The sash lock for a sash window assembly of claim 8, wherein the keeper is secured to the lower rail of the upper sash by at least two fasteners.

10. The sash lock for a sash window assembly of claim 8, wherein the height of the keeper opening is about 0.05 inches greater than the thickness of the base of the cam.

11. A sash lock, for a window with an upper sash and a lower sash, the sash lock comprising:

a lock mechanism comprising a rotatable cam disposed beneath a housing with an upper internal surface;

the cam further comprising:

(i) a base with an outer circumferential surface and an upper surface;

(ii) a linear edge segment;

(iii) a portion elevated above the base disposed opposite the linear edge segment, an upper surface of the elevated portion in direct contact with the upper internal surface of the housing and spanning at a uniform height continuously between a circular boss surrounding a through hole and an outermost surface perpendicular to the upper surface of the base and co-extensive with a portion of the outer circumferential surface, an upper surface of the base symmetrically disposed on opposite sides of the elevated portion, wherein the cam is configured for bi-directional rotational receipt into at least one of a slot within a lower frame member of an upper sash or an opening in a keeper, thereby preventing movement of the upper and lower sashes.

12. A sash lock, consisting of:

a housing member having a hole therein, the housing further comprising an interior surface and an exterior surface;

a latch cam with a through hole therein, the latch cam disposed beneath the interior surface of the housing and shaped as a truncated circle with a linear edge segment, a base with an outer edge and an elevated portion with a uniform height disposed atop the base, an upper surface of the base symmetrically disposed on opposite sides of the elevated portion, the elevated portion disposed opposite the linear edge segment and further comprising an outer edge coextensive with the outer edge of the base, a top surface of the elevated portion in direct contact with the interior surface of the housing;

an actuator member with an actuator shaft disposed substantially perpendicular to the actuator member, the actuator shaft configured for receipt into the housing member hole and the latch cam through hole, the latch cam opening and actuator shaft having corresponding circumferential surfaces; wherein, the actuator member is operable for bi-directional rotational receipt of the latch cam into a structure to prevent movement of an upper and a lower window sash relative to one another, each of the sash windows mounted within opposed guide rails on a master frame, wherein at least one of the sash windows is slidable within the frame relative to the other sash window.

13. The sash lock of claim 12, wherein the structure is a recess in the lower rail of the upper sash.

14. The sash lock of claim 12, wherein the structure is a keeper with a keeper opening.

* * * * *